US006267112B1

(12) United States Patent
Chiang

(10) Patent No.: US 6,267,112 B1
(45) Date of Patent: Jul. 31, 2001

(54) OIL COLLECTION DEVICE FOR A KITCHEN RANGE HOOD

(76) Inventor: Pi Tang Chiang, No. 402, Chung Shan Road, Sheng Kang, Hsiang, Taichung Hsien (TW)

( * ) Notice: Subject to any disclaimer, the term of this patent is extended or adjusted under 35 U.S.C. 154(b) by 0 days.

(21) Appl. No.: 09/696,290

(22) Filed: Oct. 26, 2000

(51) Int. Cl.[7] ..... F24C 15/20
(52) U.S. Cl. ..... 126/299 R; 126/299 D
(58) Field of Search ..... 126/299 R, 299 D, 126/299 F; 55/DIG. 36

(56) References Cited

U.S. PATENT DOCUMENTS 5,537,988 * 7/1996 Lin ..... 126/299 D
5,979,436 * 11/1999 Chiang et al. ..... 126/299 D

FOREIGN PATENT DOCUMENTS

2272846-A * 6/1994 (GB) ..... 126/299 D

* cited by examiner

*Primary Examiner*—Sara Clarke
(74) *Attorney, Agent, or Firm*—Bacon & Thomas, PLLC

(57) ABSTRACT

A kitchen range hood includes a casing having an open rear end and an open bottom. A rear plate is engaged with the open rear end of the casing and a flange extends radially outward from a lower edge of the casing so that a first oil collection device is engaged with the flange. A second oil collection device is engaged with a lower edge of the rear plate. A support plate has a first end engaged with the rear plate and a second end of the support plate is bent downward toward an opening of the first oil collection device. A ventilation device is supported on the support plate. Oil particles that are not sucked by the ventilation device are collected in the first and second oil collection devices.

8 Claims, 7 Drawing Sheets

OIL COLLECTION DEVICE FOR A KITCHEN RANGE HOOD

FIELD OF THE INVENTION

The present invention relates to a kitchen range hood having a peripheral oil collection device so as to collect all the oil drops possibly flowing from the casing of the kitchen range hood.

BACKGROUND OF THE INVENTION

A conventional kitchen range hood for sucking oily smoke generally includes a casing in which a motor with fans is installed and a pipe is connected to a chamber communicating with the fans so as to send the smoke from the interior of kitchen via the pipe. Nevertheless, the smoke includes a lot of oil particles and cannot to be completely sucked by the fans. To prevent some of the oil particles from adhering on the inner periphery of the casing and dropping directly to the cook top or kitchen counter, the oil collection device is therefore connected to the lower edge of the casing and is expected to collect the oil particles that remains on the casing. The conventional oil collection device is connected to a lowest edge of the casing because the designers believe that the oil particles will flow downward on the casing and finally drop into the oil collection device. However, because of viscosity of the oil particles, some of them adhered on the casing and drop at a position higher than the position where the oil collection device is connected.

The present invention intends to provide a oil collection device for a kitchen range hood wherein the oil collection device is connected along a periphery of the casing so that all the oil particles will be finally collected in the oil collection device.

SUMMARY OF THE INVENTION

In accordance with one aspect of the present invention, there is provided a kitchen range hood comprising a quarter-sphere casing having an open rear end and an open bottom, a rear plate engaged with the open rear end of the casing. A flange extends radially outward from a lower edge of the casing. A first oil collection device is engaged with the flange and has an opening facing an interior of the casing. A second oil collection device is engaged with a lower edge of the rear plate. A support plate has a first end engaged with the rear plate and a second end of the support plate is located above the opening of the first oil collection device. A ventilation device is supported on the support plate.

The primary object of the present invention is to provide a kitchen range hood the has oil collection devices connected along a periphery of the casing of the range hood so as to collect all the oil particles that are not sucked by the ventilation device in the range hood.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
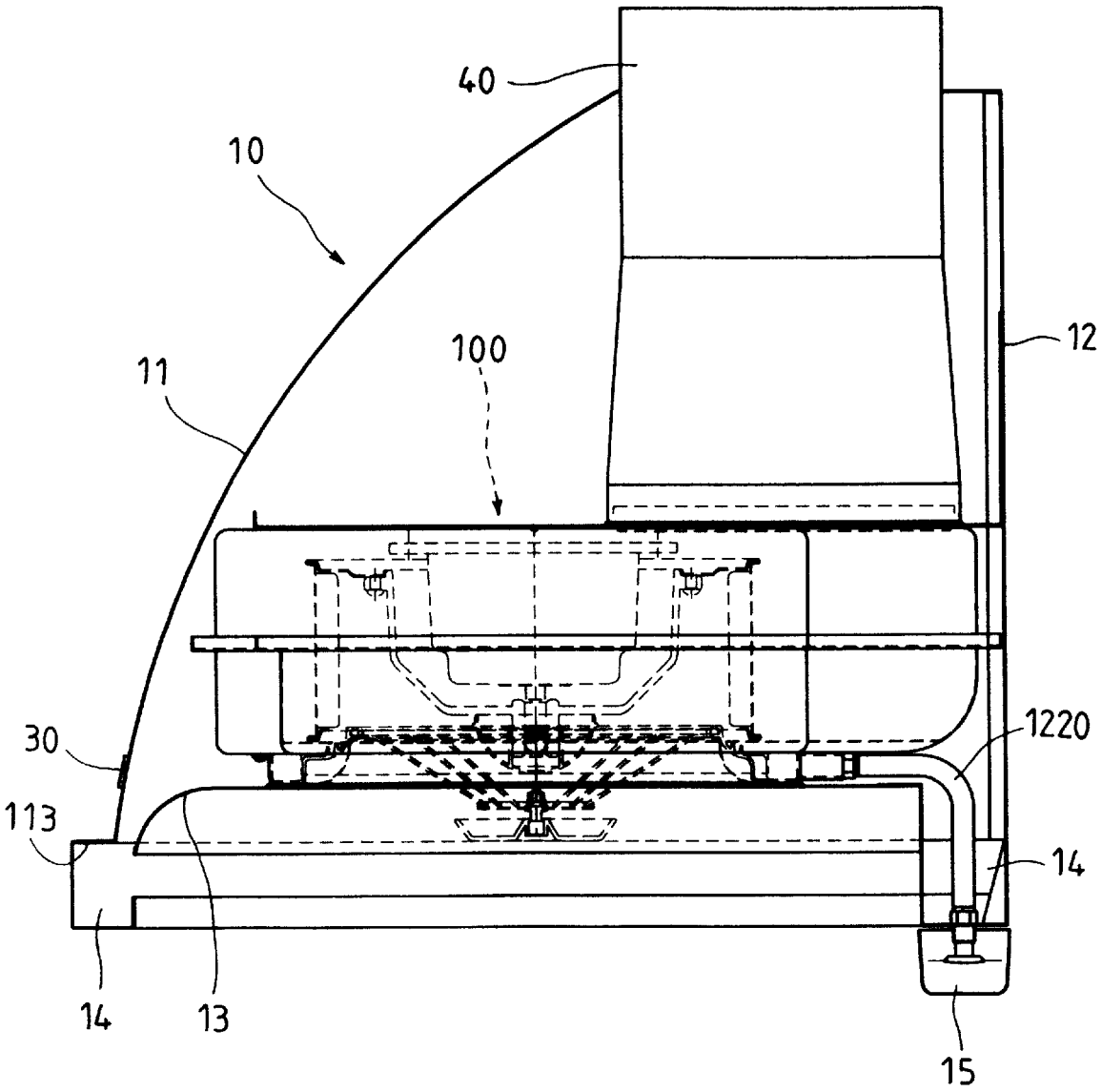
FIG. 1 is an illustrative view to show an arrangement in the interior of the range hood of the present invention.
Figure 2:
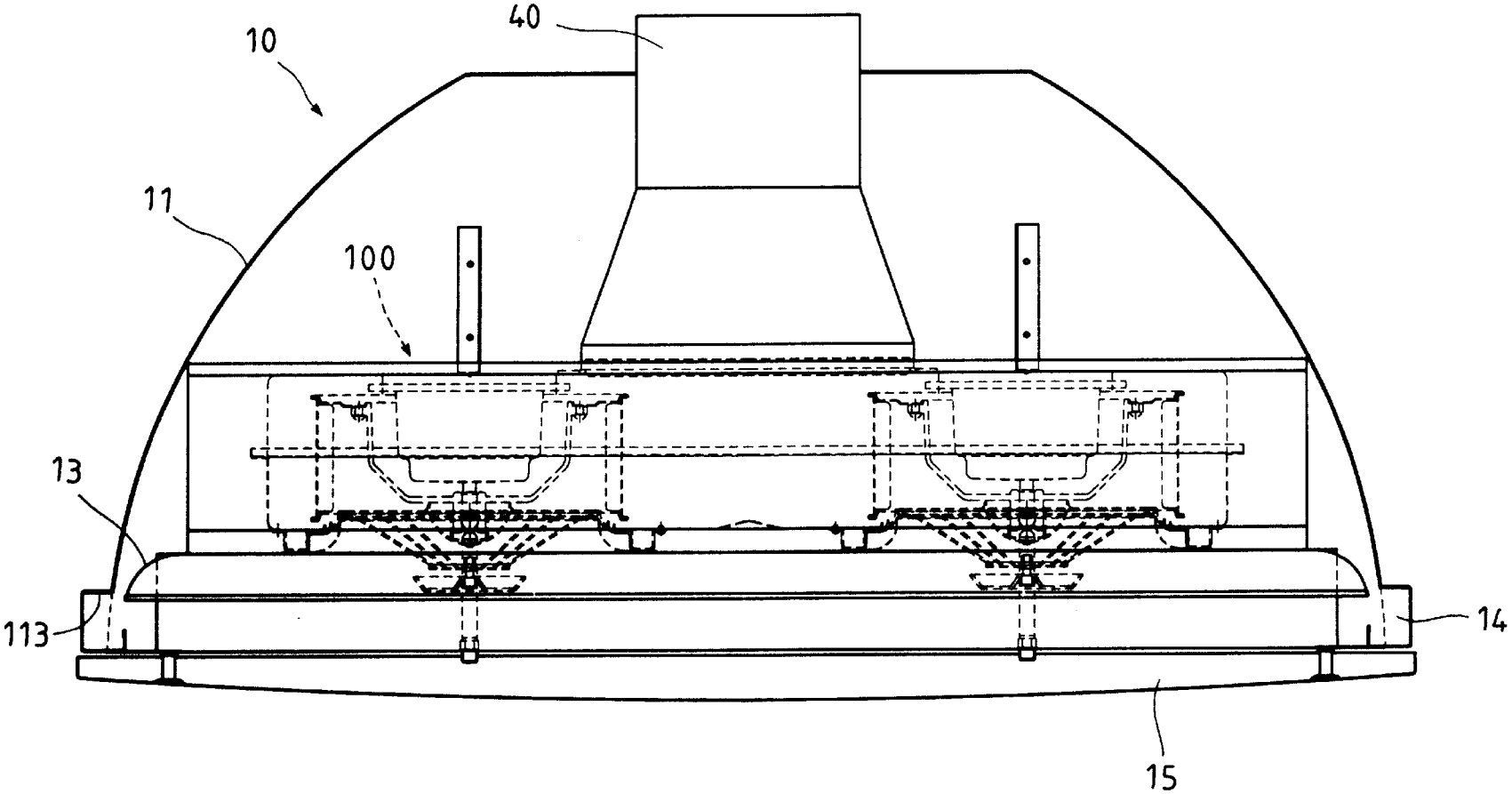
FIG. 2 is an illustrative view to show the arrangement in the interior of the range hood of the present invention when viewed from a front end of the range hood.
Figure 3:
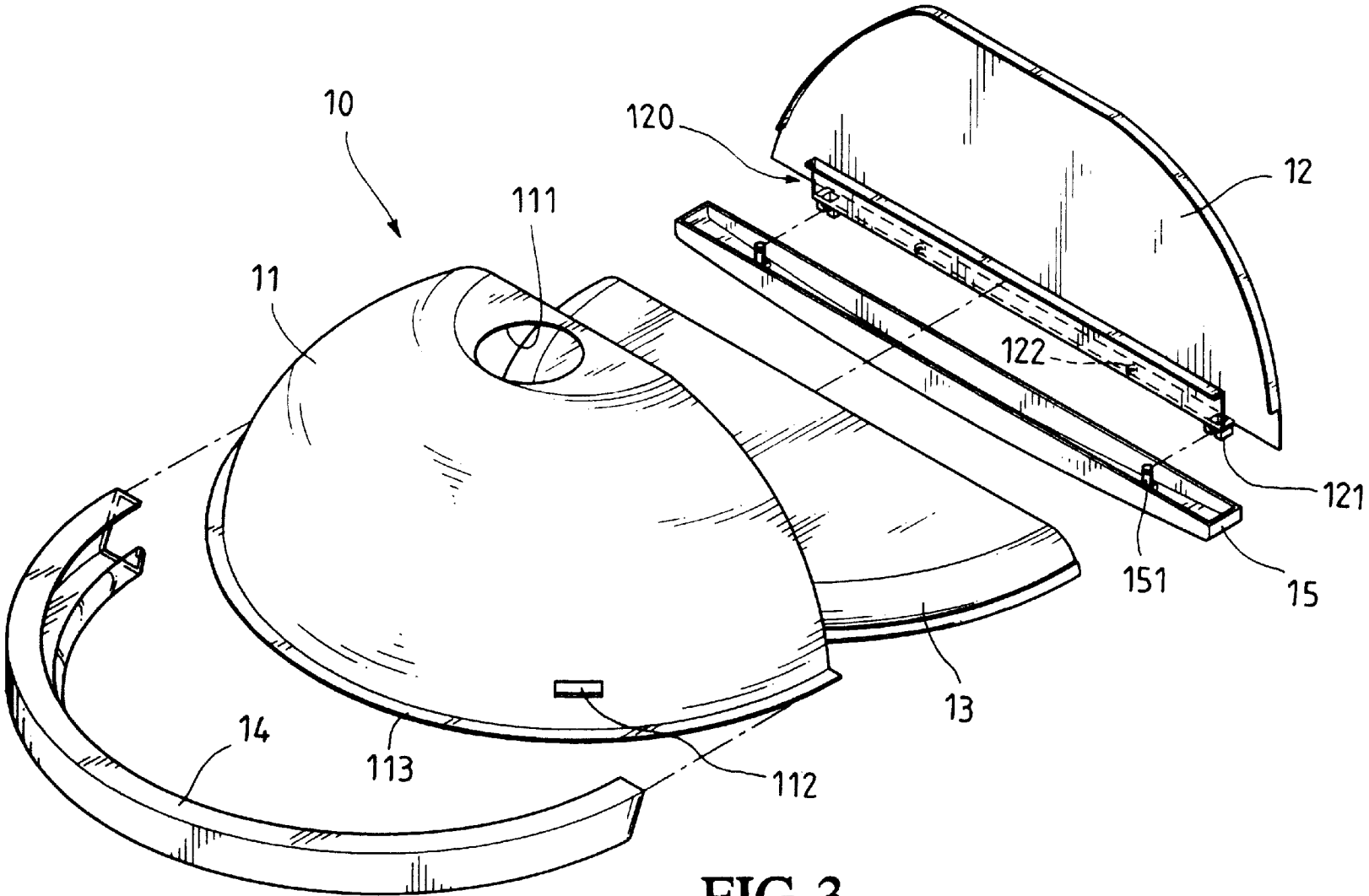
FIG. 3 is an exploded view to show a casing and oil collection devices of the range hood of the present invention.

Referring to FIGS. 1 to 3, the range hood 10 of the present invention comprises a quarter-sphere casing 11 which has smooth closed front end, an open rear end and an open bottom. An aperture 112 is defined through the casing 11 for engaging a switch 30. A flat surface is defined in a top of the casing 11 and a hole 111 is defined through the flat surface such that a pipe 40 extends through the hole 111 and engaged with a ventilation device 100 in the casing 11. A rear plate 12 is engaged with the open rear end of the casing 11 and a flange 113 extends radially outward from a lower edge of the casing 11.

Figure 4:
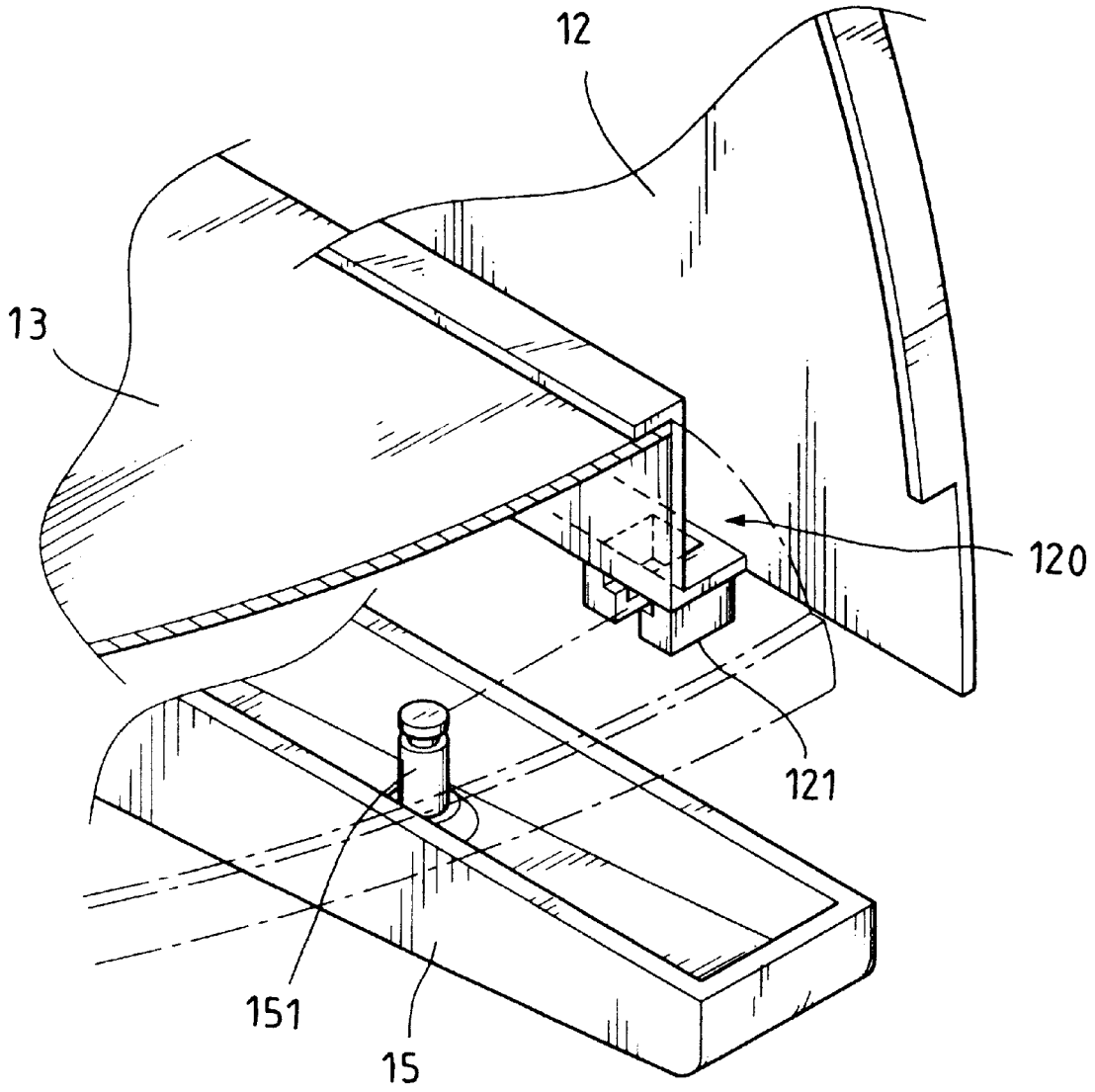
FIG. 4 is a cross sectional view to show the first end of the support plate is engaged with the rear plate of the range hood of the present invention.
Figure 5:
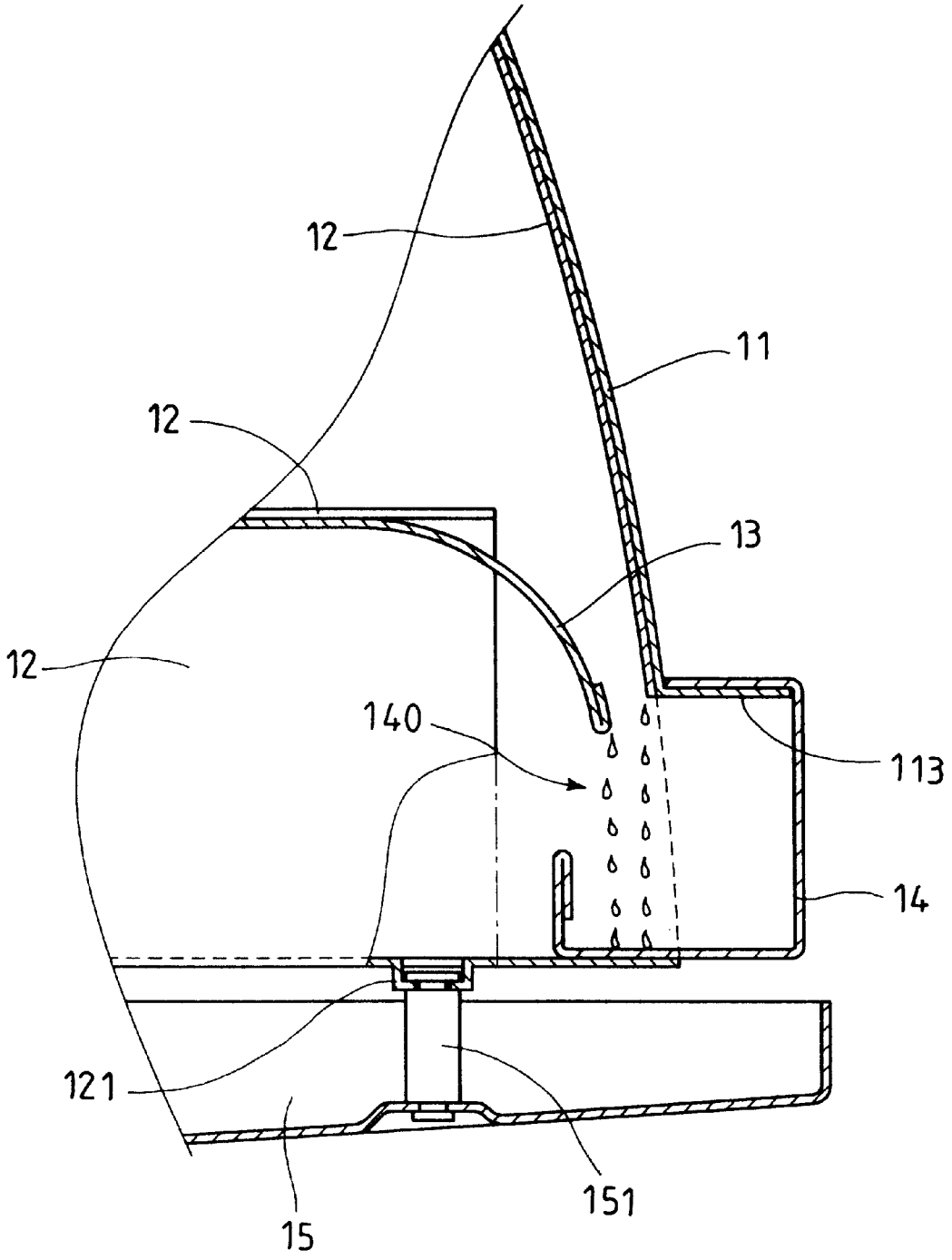
FIG. 5 is a cross sectional view to show oil particles are drop into the first oil collection device from the support plate.

Further referring to FIG. 5, a first oil collection device 14 is engaged with the flange 113 and has an opening 140 facing an interior of the casing 11. Referring to FIG. 4, the rear plate 12 has a reversed L-shape flange 120 extending toward the interior from a lower edge of the casing 11 and a plurality of clamps 121 extend from an underside of the reversed L-shaped flange 120. The reversed L-shaped flange 120 defines a groove structure on a side of the rear plate 12. A second oil collection device 15 has a plurality of connection rods 151 extending therefrom which are engaged with the clamps 121. The reversed L-shaped flange 120 has a plurality of drain holes 122 and each drain hole 122 has a tube 1220 so that oil drops drop into the second oil collection device 15 via the drain holes 122. Therefore, the second oil collection device 15 is connected along the rear plate 12.

A support plate 13 has a first end engaged with the rear plate 12 wherein the first end of the support plate 13 has a flange which is welded to an upright portion of the reversed L-shaped flange 120 of the rear plate 12 as shown in FIG. 4. A second end of the support plate 13 is located above the opening 140 of the first oil collection device 14 and the second end of the support plate 13 is bent toward the opening 140 of the first oil collection device 14 so that oil particles are easily drop into the first oil collection device 14 as shown in FIG. 5. Two ends of the first oil collection device 14 each have a shortened and inclined bottom which are located close to the rear plate 12 and above the second oil collection device 15 so that oil may drop into the second oil collection device 15 from the two ends of the first oil collection device 14. Some oil remains in the area where the ventilation device 100 is located, on the first end of the support plate 13, is allowed to flow over the welding area and is collected in the groove structure defined by the reversed L-shaped flange 120 and then drops into the second oil collection device.

Figure 6:
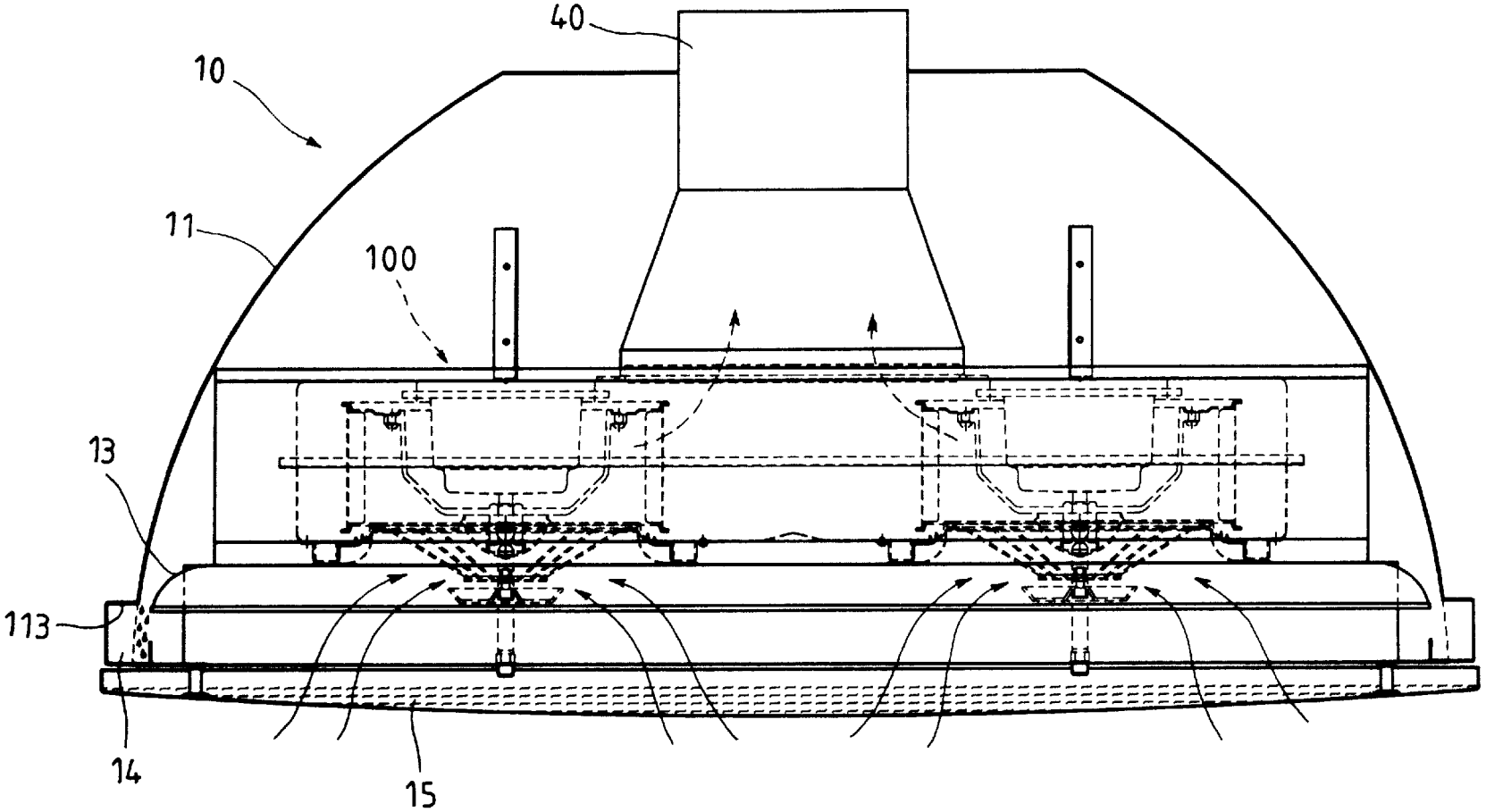
FIG. 6 is an illustrative view to show how the oil particles are sucked by the ventilation device in the range hood of the present invention.

As shown in FIG. 6, the smoke having oil particles are sucked by the ventilation device 100 and flows out from the pipe 40. Some oil particles which are not sucked by the ventilation device 100 will be collected by the first oil collection device 14 and the second oil collection device 15 respectively. Because the inner surface of the casing 11 is smooth so that there are no narrow areas which may trap oil particles and the casing 11 is easily to be cleaned.

Figure 7:
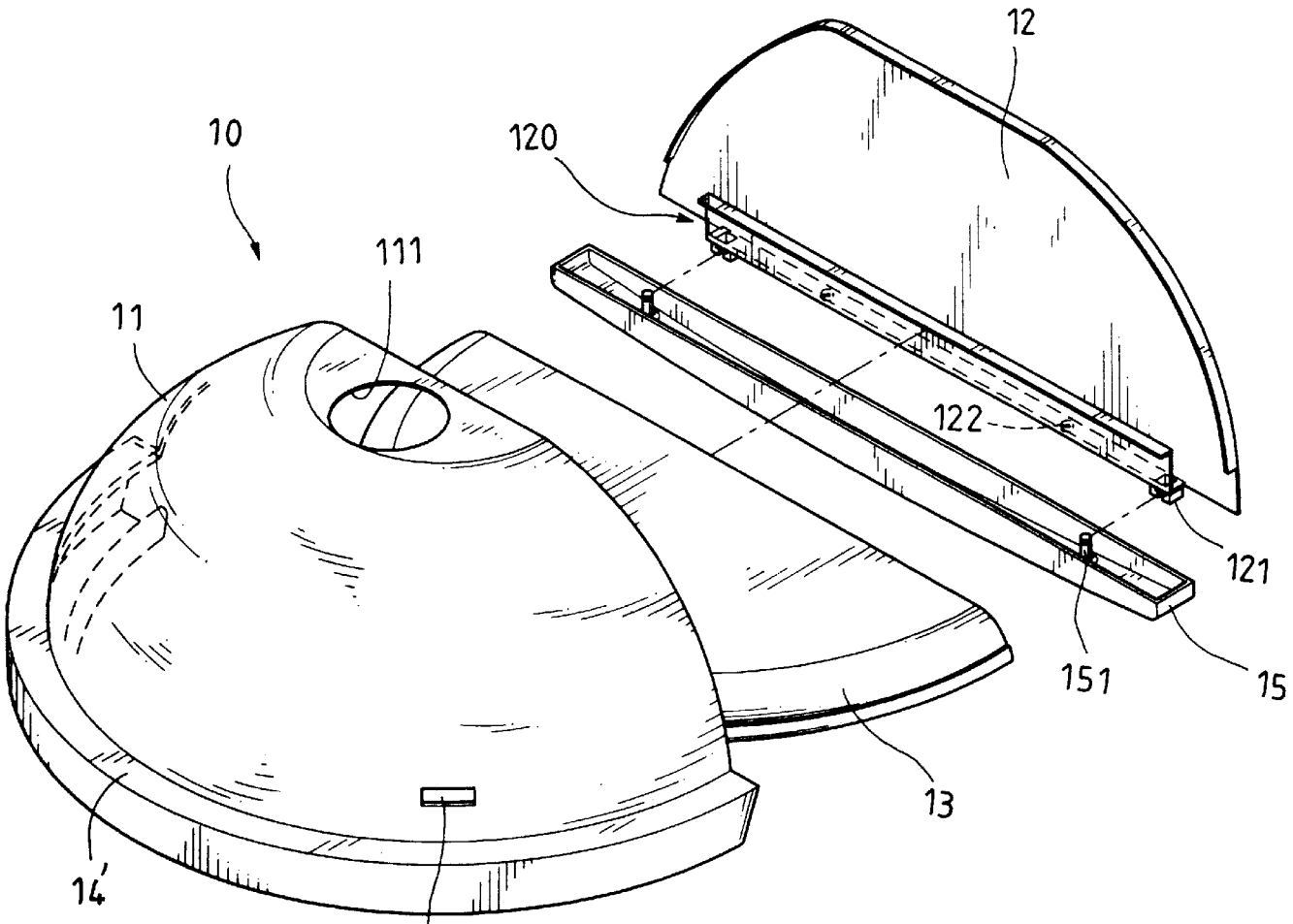
FIG. 7 is an exploded view to show the first oil collection device is integrally connected to the body of the range hood of the present invention.

FIG. 7 shows that the first oil collection device 14' can be made as an integral portion of the casing 11 and this arrangement reduces assembling processes of the range hood.

While we have shown and described various embodiments in accordance with the present invention, it should be clear to those skilled in the art that further embodiments may be made without departing from the scope and spirit of the present invention.

What is claimed is:

1. A kitchen range hood comprising:

a casing having a closed front end, an open rear end and an open bottom, a rear plate engaged with said open rear end of said casing;

a first oil collection device connected to a lower edge of said casing and having an opening facing an interior of said casing, a second oil collection device engage with a lower edge of said rear plate, and a support plate having a first end engaged with said rear plate and a second end of said support plate located above said opening of said first oil collection device, a ventilation device supported on said support plate.

2. The hood as claimed in claim 1 wherein a flange extends radially outward from said lower edge of said casing and said first oil collection device is connected said flange.

3. The hood as claimed in claim 1 further comprising a hole defined through a top of said casing and a pipe inserted into said hole.

4. The hood as claimed in claim 1, wherein said second end of said support plate bends toward said opening of said first oil collection device.

5. The hood as claimed in claim 1 wherein said rear plate has a groove structure extending therefrom and toward said interior of said casing, said first end of said support plate fixedly connected to a side of said groove structure of said rear plate.

6. The hood as claimed in claim 5 further comprising a plurality of clamps extending from an underside of said groove structure, said second oil collection device having a plurality of connection rods extending therefrom which are engaged with said clamps.

7. The hood as claimed in claim 1 wherein two ends of said first oil collection device are located above said second oil collection device.

8. The hood as claimed in claim 1 wherein said casing is a quarter-sphere casing and has a smooth inner surface.

* * * * *